US012359556B2

(12) United States Patent
Tasoujian et al.

(10) Patent No.: US 12,359,556 B2
(45) Date of Patent: Jul. 15, 2025

(54) ROBUST LINEAR PARAMETER VARYING CONTROL DESIGN FOR AUTOMATED CURVATURE CRUISE

(71) Applicant: Halliburton Energy Services, Inc., Houston, TX (US)

(72) Inventors: Shahin Tasoujian, Sunnyvale, CA (US); Yuanyan Chen, Houston, TX (US); Khunsa Hisham, Houston, TX (US); Vy Pho, Houston, TX (US); Ketan C. Bhaidasna, Houston, TX (US); Robert P. Darbe, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 399 days.

(21) Appl. No.: 17/974,368

(22) Filed: Oct. 26, 2022

(65) Prior Publication Data

US 2024/0159142 A1 May 16, 2024

(51) Int. Cl.

| | |
|---|---|
| ***E21B 47/02*** | (2006.01) |
| ***E21B 7/04*** | (2006.01) |
| ***E21B 44/00*** | (2006.01) |
| ***E21B 47/022*** | (2012.01) |

(52) U.S. Cl.

CPC ..... *E21B 47/022* (2013.01); *E21B 7/04* (2013.01); *E21B 44/00* (2013.01); *E21B 2200/20* (2020.05)

(58) Field of Classification Search

CPC ..... E21B 47/022; E21B 7/04; E21B 44/00; E21B 2200/20

See application file for complete search history.

(56) References Cited

U.S. PATENT DOCUMENTS

| | | | | |
|---|---|---|---|---|
| 2016/0160628 | A1 | 6/2016 | Sugiura et al. | |
| 2019/0345771 | A1* | 11/2019 | Zalluhoglu | E21B 7/10 |
| 2020/0072034 | A1* | 3/2020 | Zalluhoglu | E21B 47/022 |
| 2020/0095860 | A1* | 3/2020 | Zalluhoglu | E21B 47/022 |

(Continued)

FOREIGN PATENT DOCUMENTS

| | | |
|---|---|---|
| WO | 2024091277 | 5/2024 |

OTHER PUBLICATIONS

"PCT Application No. PCT/US2022/079071, International Search Report and Written Opinion", Jul. 19, 2023, 7 pages.

(Continued)

*Primary Examiner* — Christopher W Carter

(74) *Attorney, Agent, or Firm* — DeLizio, Peacock, Lewin & Guerra, LLP

(57) ABSTRACT

A computer-implemented method for drilling a curve section of a wellbore in a subsurface formation. The method comprises obtaining a curvature setpoint. The method comprises obtaining drilling process feedback from a drilling assembly drilling the curve section of the wellbore. The method comprises updating a scheduling parameter vector based on the drilling process feedback. The method comprises updating a controller, wherein the controller is configured with the scheduling parameter vector. The method comprises determining an error based on the curvature setpoint and the drilling process feedback. The method comprises inputting the error into the controller. The method comprises determining, via the controller, steering decisions based on the error and the scheduling parameter vector.

20 Claims, 4 Drawing Sheets

(56) References Cited

U.S. PATENT DOCUMENTS

| | | | |
|---|---|---|---|
| 2021/0164293 | A1 | 6/2021 | Zhao et al. |
| 2022/0018191 | A1 | 1/2022 | Bayliss |

OTHER PUBLICATIONS

Cheng, "Modeling and Control of Drill-String System With Stick-Slip Vibrations Using LPV Technique", IEEE Transactions on Control Systems Technology, vol. 29, No. 2, Mar. 1, 2021, 12 pages.
Inyang, et al., "Bilinear modelling, control and stability of directional drilling", Control Engineering Practice, vol. 82, Oct. 25, 2018, 11 pages.

* cited by examiner

ROBUST LINEAR PARAMETER VARYING CONTROL DESIGN FOR AUTOMATED CURVATURE CRUISE

FIELD

The disclosure generally relates to directional drilling and, in particular, determining steering inputs to directional drill a wellbore through a subsurface formation.

BACKGROUND

Control automation is utilized throughout the oil and gas industry in applications such as directional drilling to reduce error and optimize processes. The process of drilling a wellbore in a geological formation includes directional drilling sections to guide the wellbore towards a predetermined target. Directional drilling comprises controlling the attitude (inclination and azimuth) and/or the position (True Vertical Depth, North/South, East/West) of the wellbore using drilling operation parameters and downhole tools to guide the wellbore along a planned well path (i.e., well plan) towards a predetermined target. Directional drilling is controlled to maintain the wellbore trajectory within range of the well plan to avoid additional drilling time and incorrect wellbore placement in the reservoir. As the system dynamics and geological formations vary along the wellbore, steering inputs and/or drilling operation parameters need to change to adapt to the new conditions. Automation assists directional drilling to keep the wellbore on the planned well path while minimizing error and non-productive time.

BRIEF DESCRIPTION OF THE DRAWINGS

The present invention is illustrated by way of example and not limitation in the Figures of the accompanying drawings in which.

DESCRIPTION OF EMBODIMENTS

Figure 1:
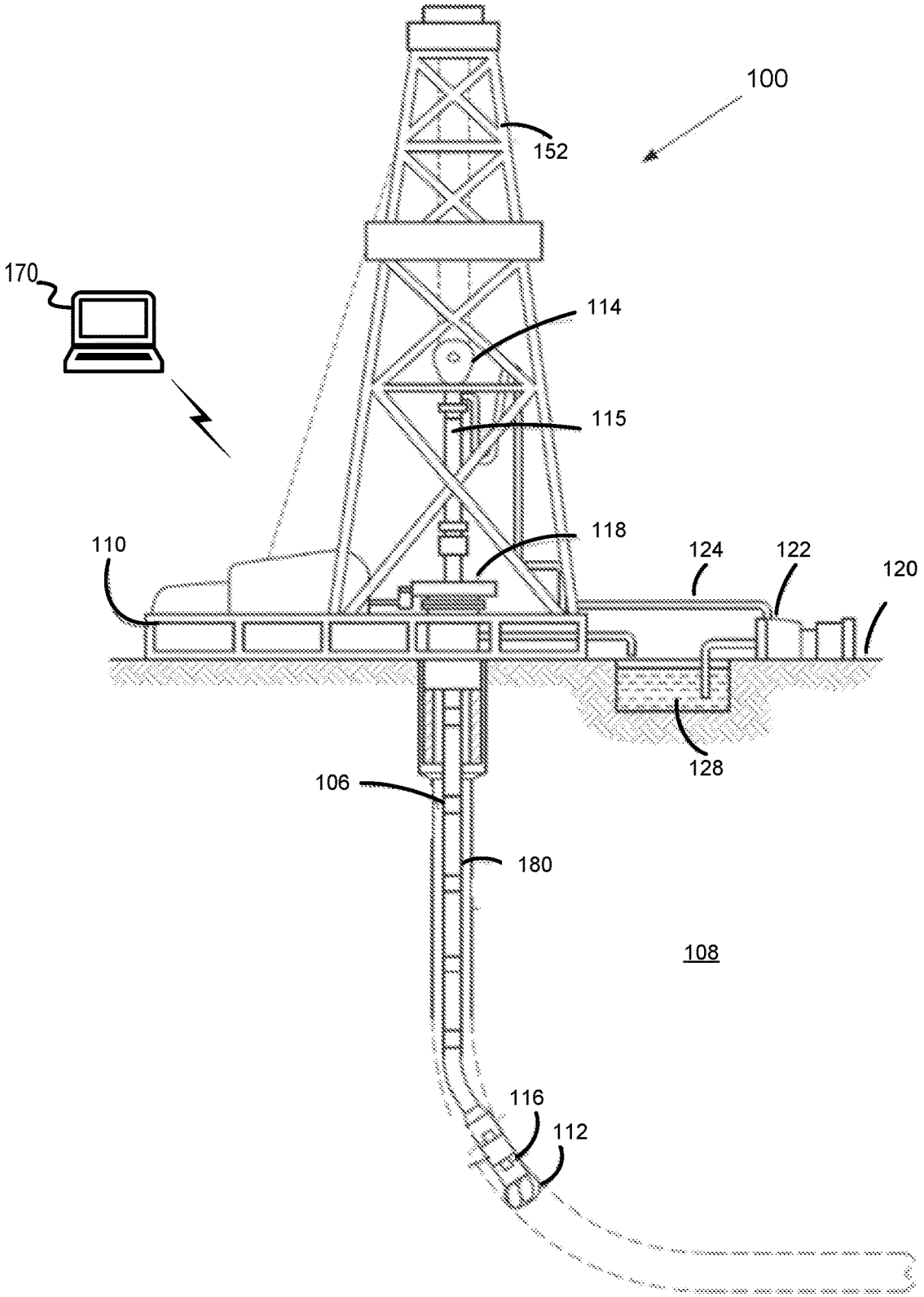
FIG. 1 depicts an example well system, according to some embodiments.

The description that follows includes example systems, methods, techniques, and program flows that embody embodiments of the disclosure. However, it is understood that this disclosure may be practiced without these specific details. For instance, this disclosure refers to a linear parameter-varying (LPV) controller configured with a wellbore propagation model. Embodiments of this disclosure can also include LPV controllers configured with other model representations. In other instances, well-known instruction instances, protocols, structures, and techniques have not been shown in detail in order not to obfuscate the description.

Overview

In operations for drilling a wellbore in a subsurface formation, a drill bit may be steered through a subsurface formation to form the wellbore. As the wellbore is drilled, operators may obtain measurements that indicate the position and trajectory of the wellbore. Accordingly, steering decisions may be generated and communicated to the drilling assembly to steer the drill bit and keep the wellbore on a planned well path. Some implementations of the inventive subject matter utilize a controller (such as a linear parameter varying (LPV) controller or other suitable controller) to drill a curve section of the wellbore in the subsurface formation.

Some implementations may obtain setpoints from an operator. For example, a curvature setpoint and an attitude setpoint may be obtained from an operator. Some implementations may also obtain drilling process feedback from a drilling assembly drilling the curve section of the wellbore. For example, drilling operation parameters measurements and attitude measurements may be obtained from tools located on the drilling assembly. The drilling process feedback may indicate the current position and trajectory of the wellbore as well. Additionally, the drilling process feedback may indicate the relationship between drilling operation parameters and the bit-rock interaction. After obtaining the drilling process feedback, the drilling process feedback may be used to update a scheduling parameter vector. Subsequently, a controller configured with the scheduling parameter vector may be updated. Additionally, an error may be determined based on the drilling process feedback and the setpoints. The error may be input into the controller. After receiving the error, the LPV controller may determine steering decisions. Hence, the controller may determine steering decisions to drill the curve section of the wellbore according to a planned well path.

In some implementations, the steering decisions may be used to perform a drilling operations. For example, a downhole operation may be initiated, modified, or stopped based on the steering decisions. Examples of such drilling operations may include adjusting the drilling assembly orientation, updating drilling operations, stopping drilling operations, etc. For instance, steering inputs (i.e., tool face orientation and duty cycle) may be determined based on the steering decisions. The steering inputs may be communicated to the drilling assembly and implementing into the drilling process. Accordingly, the drilling assembly may be adjusted to maintain the a target curvature and a target attitude such that the wellbore stays on the planned well path.

Example Drilling System

FIG. 1 depicts an example well system, according to some embodiments. In particular, FIG. 1 is a schematic diagram of a well system 100 that includes a drill string 180 having a drill bit 112 disposed in a wellbore 106 for drilling the wellbore 106 in the subsurface formation 108. While depicted for a land-based well system, example embodiments can be used in subsea operations that employ floating or sea-based platforms and rigs.

The well system 100 may further include a drilling platform 110 that supports a derrick 152 having a traveling block 114 for raising and lowering the drill string 180. The drill string 180 may include, but is not limited to, drill pipe, drill collars, and drilling assembly 116. The drilling assembly 116 may comprise any of a number of different types of tools including a rotary steerable system (RSS), measurement while drilling (MWD) tools, logging while drilling (LWD) tools, mud motors, etc. A kelly 115 may support the drill string 180 as it may be lowered through a rotary table 118. The drill bit 112 may include roller cone bits, polycrystalline diamond compact (PDC) bits, natural diamond bits, any hole openers, reamers, coring bits, and the like. As the drill bit 112 rotates, it may crush or cut rock to create and extend a wellbore 106 that penetrates various subterranean formations. The drill bit 112 may be rotated by various methods including rotation by a downhole mud motor and/or via rotation of the drill string 180 from the surface 120 by the rotary table 118. Drilling operation parameters of drilling the wellbore may be adjusted to increase, decrease, and/or maintain the rate of penetration (ROP) of the drill bit 112 through the subsurface formation 108. Drilling operation parameters may include weight-on-bit (WOB) and rotations-per-minute (RPM) of the drill string 180. A pump 122 may circulate drilling fluid through a feed pipe 124 to the kelly 116, downhole through interior of the drill string 180, through orifices in the drill bit 112, back to the surface 120 via an annulus surrounding the drill string 180, and into a retention pit 128.

In some embodiments, various sections of the wellbore 106 such as the vertical, tangent, curve, and horizontal section may require directional drilling to steer the drill bit 112 on a planned well path. Drilling process feedback, such as attitude measurements (i.e., inclination and azimuth), rate of penetration (WOB), weight on bit (WOB), etc. may be obtained from tools on the drilling assembly 116 and uplinked to the surface 120. In some embodiments, the drilling process feedback may be communicated to tools on the drilling assembly 116 for processing. The drilling process feedback may be processed and utilized to determine wellbore position relative to the planned well path. Additionally, steering inputs such as tool face orientation and duty cycle may be determined based on the drilling process feedback. The steering inputs may be communicated back to the drilling assembly 116 for implementation to maintain the planned well path for the respective wellbore section.

Figure 4:
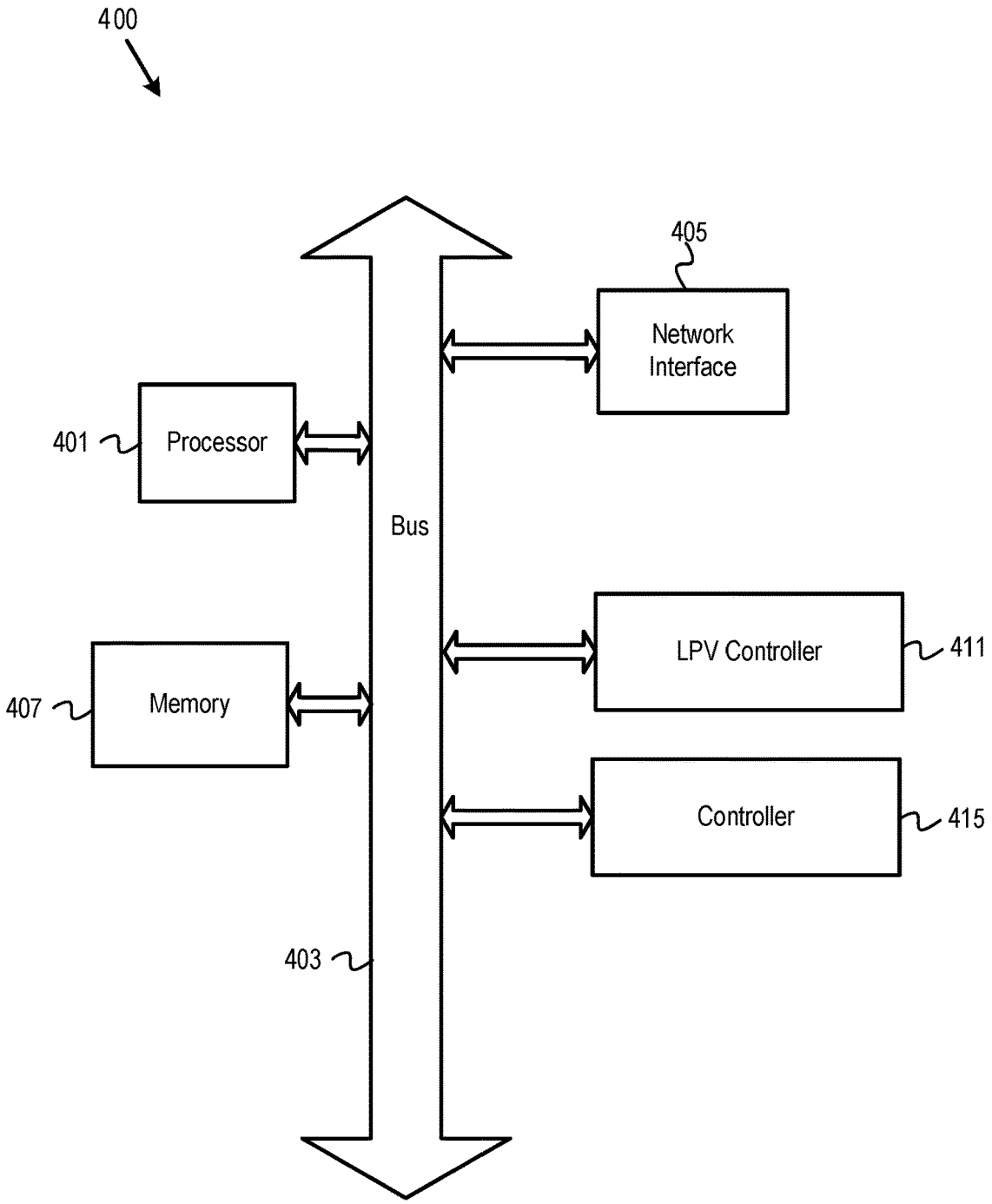
FIG. 4 depicts an example computer, according to some embodiments.

The well system 100 includes a computer 170 that may be communicatively coupled to other parts of the well system 100. The computer 170 can be local or remote to the drilling platform 110. A processor of the computer 170 may perform simulations (as further described below). In some embodiments, the processor of the computer 170 may control drilling operations of the well system 100 or subsequent drilling operations of other wellbores. For instance, the processor of the computer 170) may determine the wellbore position in the subsurface formation 108 and steering inputs to maintain a planned well path for a section of a wellbore. An example of the computer 170 is depicted in FIG. 4, which is further described below.

Example Operations

Figure 2:
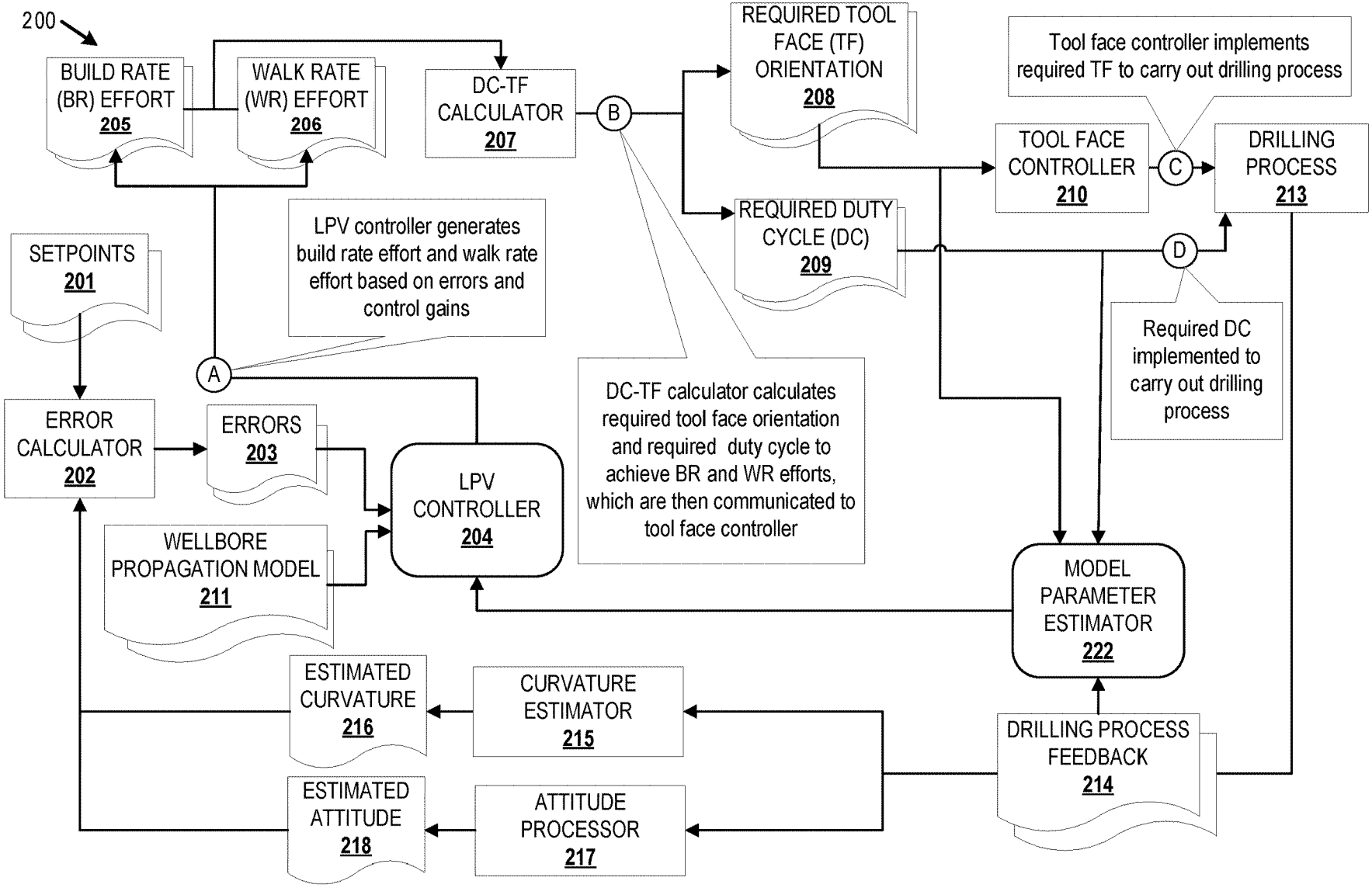
FIG. 2 depicts a conceptual diagram of a controller generating steering inputs for implementation into a drilling process, according to some embodiments.

FIG. 2 depicts a conceptual diagram of a controller generating steering inputs for implementation into a drilling process, according to some embodiments. FIG. 2 depicts an LPV curvature cruise controller 200 that includes an LPV controller 204. In some embodiments, the curvature cruise controller may not be an LVP cruise controller, and may any suitable controller type. Operations of the LPV curvature cruise controller 200 are described in reference to the computer 170 of FIG. 1. The computer 170 may perform any or all of the operations described with reference to FIG. 2. The developed LPV gain-scheduling output-feedback control design may use a linear matrix inequalities (LMI) and may be configured to maintain/track/control (i.e., hold) a specified curvature setpoint(s) that may be constant or varying along the wellbore's curve section. The LPV curvature cruise controller 200 may be implemented for the autonomous drilling purpose both on the surface and downhole. The proposed control design scheme can be easily implemented as a drilling advisory system.

At stage A, the LPV controller 204 may generate steering decisions based on errors 203 and model parameters corresponding to drilling process feedback 214. Steering decisions generated by the LPV controller 204 may include build rate ("BR") effort 205 and walk rate ("WR") effort 206. The BR effort 205 comprises the build rate (i.e., the rate at which the wellbore builds in the vertical plane) required by the drilling assembly to minimize errors 203 at current drilling operation parameters measurements, such as ROP and WOB. Likewise, the WR effort 206 comprises the walk rate (i.e., the rate at which the wellbore builds in the horizontal plane) required by drilling assembly to minimize errors 203 at current drilling operation parameters measurements.

Errors 203, calculated by error calculator 202, may be based on setpoints 201, estimated curvature 216, and estimated attitude 218. Setpoints 201 may include a curvature setpoint and an attitude setpoint. The errors 203 may be the difference between the curvature setpoint and the estimated curvature 216, as well as the attitude setpoint and estimated attitude 218. A user, such as a geologist or directional driller, may provide the setpoints 201. The curvature setpoint may indicate a target curvature for a two-dimensional (2D) or three-dimensional curve (3D) section of a wellbore. The curvature setpoint may be expressed as a target build/drop rate expressed in degrees per 100 feet (deg/100 feet) and a target walk/turn rate expressed in deg/100 feet. The curvature setpoint may be in the time domain or depth domain. For example, the curvature setpoint may be indicated as drop rate of 8 deg/100 feet and a turn rate of 0 deg/100 feet for 500 feet drilled. The attitude setpoint may indicate a target position in the subsurface formation. For instance, the attitude setpoint may indicate the end of the curve section. The attitude setpoint may include inclination, expressed in degrees, and azimuth, expressed in degrees.

The drilling process feedback 214 may be obtained by tools on the drilling assembly as the wellbore is drilled during the drilling process 213. The drilling process feedback 214 may include attitude measurements and drilling operation parameter measurements. Attitude measurements may include inclination and azimuth of the wellbore. Drilling operation parameter measurements may include measurements at the drilling assembly or surface measurements such as weight on bit (WOB), torque on bit (TOB), rate of penetration (ROP), flow rate, etc. The attitude measurement of the drilling process feedback 214 may be fed to a curvature estimator 215 and an attitude processor 217.

The estimated curvature 216 may be generated by the curvature estimator 215. Curvature estimator 215 may estimate the wellbore curvature by utilizing attitude measurements of the drilling process feedback 214 (e.g., inclination and azimuth) obtained from two or more MWD tools mounted on the drilling assembly at a set predetermined distance. The curvature estimator 215 may also use other techniques to determine the estimated curvature 216. For example, the curvature estimator 215 may obtain two or more attitude measurements and their corresponding depths from one MWD tool mounted on the drilling assembly. The attitude processor 217 may obtain attitude measurements of the drilling process feedback 214 to generate the estimated attitude 218. The attitude processor 217 may perform various operations on the raw attitude measurements, such as filtering, to generate the estimated attitude 218.

The errors 203 calculated by the error calculator 202 may be input into the LPV controller 204. In some embodiments, if the errors are less than a threshold then new steering decisions may not be generated. For instance, the threshold may be set to indicate the estimated curvature 216 and estimated attitude 218 are acceptable relative to the setpoints 201 such that steering decisions are not necessary to decrease the errors 203. For example, a threshold of 0.01, 0.05, etc. deg/100 feet of curvature may be set to indicate that the LPV controller 204 does not need to generate new steering decisions if the curvature error is greater than, equal to, or less than the defined threshold. In some embodiments, the threshold may be zero, indicating that new steering decisions may be generated if the errors 203 are not equal to zero.

The model parameters may enable the LPV controller 204 to be implemented into the directional drilling process. In some embodiments, to enable the LPV controller 204 for the directional drilling process a wellbore propagation model 211 may considered to describe the directional response of the drilling tool (inclination and azimuthal dynamics) and define relationship between relevant drilling parameters and bit-rock interaction. The wellbore propagation model 211, represented by $\dot{x}(t)$ (Equation 1), may be defined as:

$$\dot{x}(t) = \underbrace{\begin{bmatrix} -\frac{1}{\tau(t)} & 0 \\ 1 & 0 \end{bmatrix}}_{A(t)} x(t) + \underbrace{\begin{bmatrix} \frac{K(t)}{\tau(t)} \\ 0 \end{bmatrix}}_{B_1(t)} u(t) + \underbrace{\begin{bmatrix} \frac{K_{bias}(t)}{\tau(t)} \\ 0 \end{bmatrix}}_{B_2(t)} w(t) \tag{1}$$

The LPV controller 204 may be configured with the wellbore propagation model that characterizes the tool's response dynamics. The LPV controller 204 may be configured with other model representations and is not limited to the example wellbore propagation model (Equation 1). Without loss of generality, the wellbore propagation model representation (Equation 1) may also be in depth domain (i.e., may replace t with s in Equation 1).

In Equation 1, the dynamic model may explain both inclination and azimuthal dynamics. $\tau$ denotes the time/depth constant of the dynamics expressed in seconds or feet. K is the maximum curvature generation capability of the drilling tool (in inclination or azimuth planes) expressed in deg/sec or deg/100 feet. $K_{bias}$ is the bias term that affects borehole propagation (for example, in inclination plane, it can be due to gravity effect etc.) expressed in deg/sec or deg/100 feet. In Equation 1, the system state vector denoted as $$x(t) = \begin{bmatrix} \kappa_\theta \\ \theta \end{bmatrix} \text{ or } x(t) = \begin{bmatrix} \kappa_\phi \\ \phi \end{bmatrix},$$

for inclination and azimuthal dynamics respectively, where $\theta$ and $\phi$ are the wellbore inclination and azimuth expressed in degrees, $\kappa_\theta=\dot{\theta}$ and $\kappa_\phi=\dot{\phi}$ are the inclination variation rate (build/drop rate) and azimuth change rate (walk/turn rate) expressed in deg/sec or deg/100 feet, respectively. The control input is represented by u(t), where $u=u_\theta$, $u_\phi \in [-1, 1]$ in inclination or azimuth planes, respectively. w(t) represents unmodeled dynamics, uncertainties, bias, or disturbances from formations. The disturbance term may capture known dynamical bias such as formation push and gravity effects. The disturbance term may be configured based on domain knowledge and (quasi) real time data.

Model parameters may include $\tau$, K, and $K_{bias}$ of the wellbore propagation model. The model parameters may depend on factors including, but not limited to, the bottom hole assembly (BHA) configuration (i.e., drilling assembly configuration), formation properties, and drilling operation parameters measurements. For example, model parameters for a wellbore propagation model for a BHA with a first drill bit drilling in a first formation will differ from the model parameters for a BHA with a second drill bit in a second formation. Moreover, model parameters of the wellbore propagation model (Equation 1) may take different values in inclination and azimuth planes. The wellbore propagation model (Equation 1) may map the drilling system's input to an output response (i.e., the tool's response dynamics). The model parameters of wellbore propagation model (Equation 1) may be calibrated based on feedback measurements as drilling proceeds. Calibrating model parameters facilitates the wellbore propagation model (Equation 1) to better capture the change in drilling conditions such as the tool's response dynamics or formation properties.

To apply the LPV controller 204 to the directional drilling application, the wellbore propagation dynamics (Equation 1) may be represented as a suitable LPV model representation. Subsequently, the LPV controller 204 may be designed, wherein the model parameters ($\tau(t)$, K(t), $K_{bias}(t)$)) may be continuously estimated/calibrated via estimation methods, such as Markov chain Monte Carlo (MCMC), and utilized as scheduling parameters of the LPV controller 204.

By considering the borehole propagation dynamics (Equation 1), the state-space LPV representation of the tool's response (Equation 2) may take the following form:

$$\begin{aligned} \dot{x}(t) &= A(\rho(t))x(t) + B_1(\rho(t))w(t) + B_2(\rho(t))u(t), \\ z(t) &= C_1(\rho(t))x(t) + D_{11}(\rho(t))w(t) + D_{12}(\rho(t))u(t), \\ y(t) &= C_2(\rho(t))x(t) + D_{21}(\rho(t))w(t) \end{aligned} \tag{2}$$

where $x^T(t)=[\kappa^T(t)\ x_2^T(t)\ \zeta^T(t)]$ is the augmented state vector and $\kappa(t)$ is curvature state of the system (build rate, $\kappa_\theta$, in inclination plane dynamics, or walk rate, $\kappa_\phi$, in azimuth plane dynamics), $x_2(t)$ denotes attitude state of the system (inclination $\theta$, or azimuth $\phi$), and $\zeta(t)=\int(\kappa_{set}-\kappa)dt$ is the integral of curvature error, which may be introduced for the command tracking purposes (i.e., to enable the curvature cruise controller follow arbitrary non-zero curvature setpoint). Moreover, $\rho(t)=[\tau(t)\ K(t)\ K_{bias}(t)]^T$ denotes the scheduling parameter vector, $w(t)=[r(t)=\kappa_{set}(t), d(t)]^T$ stands for the exogenous disturbance vector including the reference command (i.e., the time-varying curvature setpoint, either build/drop setpoint and/or turn/walk setpoint) and disturbance signal. Thus, the state-space matrices of the LPV model representation of borehole propagation dynamics (Equation 3) may be obtained as:

$$A(\rho(t)) = \begin{bmatrix} -\frac{1}{\rho_1(t)} & 0 & 0 \\ 1 & 0 & 0 \\ -1 & 0 & 0 \end{bmatrix}, B_1(\rho(t)) = \begin{bmatrix} \frac{\rho_2(t)}{\rho_1(t)} \\ 0 \\ 0 \end{bmatrix}, B_2(\rho(t)) = \begin{bmatrix} 0 & \frac{\rho_3(t)}{\rho_1(t)} \\ 0 & 0 \\ 1 & 0 \end{bmatrix}, \tag{3}$$

$$C_1 = \begin{bmatrix} \phi_1 & 0 & 0 \\ 0 & \phi_2 & 0 \\ 0 & 0 & \phi_3 \\ 0 & 0 & 0 \end{bmatrix}, D_{11} = 0_{4\times 2}, D_{12} = \begin{bmatrix} 0 \\ 0 \\ 0 \\ \psi \end{bmatrix},$$

$$C_2 = \begin{bmatrix} 1 & 0 & 0 \\ 0 & 1 & 0 \end{bmatrix}, D_{21} = 0_{2\times 2}$$

where $\rho(t)=[\tau(t)\ K(t)\ K_{bias}(t)]^T$ is the scheduling parameter vector with $\rho_1(t)=\tau(t)$, $\rho_2(t)=K(t)$, $\tau_3=K_{bias}(t)$. Moreover, in Equation 3 the vector of the target outputs to be controlled (Equation 4) may be considered as:

$$(t) = \begin{bmatrix} \phi_1 \cdot \kappa(t) \\ \phi_2 \cdot x_2(t) \\ \phi_3 \cdot \zeta(t) \\ \psi \cdot u(t) \end{bmatrix} \quad (4)$$

where $\phi_1$, $\phi_2$, $\phi_3$, and $\psi$ are weighting scalars (penalizing factors) for curvature state, $\kappa(t)$, attitude state of the system, $x_2(t)$, the curvature tracking error state, $\zeta(t)$, and the control effort, u(t), respectively. The choice of these scalars determines the relative weighting in the optimization scheme and depends on desired performance objectives.

To implement the LPV controller to directional drilling, a model parameter estimator 222 may provide scheduling parameters estimation, $\rho(t)$, which may be used by the LPV controller 204. Drilling process feedback 214 may be input into the model parameter estimator 222. Steering inputs such as the required tool face orientation 208 and the required duty cycle 209 may also be input into the model parameter estimator 222. The model parameter estimator 222 may use techniques including MCMC to generate the model parameters (i.e., scheduling parameters for the scheduling parameter vector, $\rho(t)$). The model parameters generated by the model parameter estimator 222 corresponding to different system operating points may be estimated at the current drilling depth by employing drilling operation parameters measurements (e.g., MWD, ROP, WOB, etc.). The model parameters may then used to update/calibrate the scheduling parameter vector, $\rho(t)$, and subsequently the LPV controller of the wellbore propagation process and accordingly to update the developed model-based LPV gain-scheduling controller matrices. The matrices and additional details of the LPV controller 204 design process are described at the end of FIG. 2.

In some embodiments, the LPV controller may be updated/calibrated with the model parameters at a different frequency than inputting errors 203 into the LPV controller. For instance, the sensors on the BHA may generate attitude measurements and drilling operation parameters measurements of the drilling process feedback at different frequencies during the drilling process. Attitude measurements may be obtained every 30 feet, 60 feet, 90 feet, etc. when surveys are taken. Drilling operation parameters measurements may be obtained more frequently (i.e., every 1 foot, 3 feet, etc.). Accordingly, model parameters may be generated (by the model parameter estimator 222) and communicated to the LPV controller 204 more frequently than the errors 203 derived from the attitude measurements. In some embodiments, the model parameter estimator 222 may configured to update the model parameters based on a time interval. For example, the model parameter estimator 222 may update the model parameters every 30 seconds, 1 minute, 5 minutes, etc. In some instances, the LPV curvature cruise controller 200 may be configured to delay updating the LPV controller 204 with them model parameters until attitude measurements are available.

After inputting the errors 203 into the LPV controller 204 that may be tuned with the model parameters generated by the model parameter estimator 222, the LPV controller 204 generates steering decisions including build rate (BR) effort 205 and walk rate (WR) effort 206. The BR effort 205 and the WR effort 206 may then be input into a DC-TF (duty cycle-tool face) calculator 207.

At stage B, DC-TF calculator 207 may generate the required tool face (TF) orientation 208 and the required duty cycle (DC) 209 based on BR effort 205 and WR effort 206. The required TF orientation 208 comprises the angle in which the drill bit faces with respect to the BHA (i.e., drilling assembly). The required DC 209 comprises the amount of steering force needed from the BHA. Together, the required TF orientation 208 and the required DC 209 may aim to achieve the build rate and walk rate efforts to minimize errors 203. The required DC 209 may be represented as a percentage of the maximum steering capability of the tool. For example, 100% duty cycle would mean full steering capabilities of the BHA are needed to achieve the build rate and walk rate efforts. The required TF orientation 208 may communicated to the tool face controller 210. The tool face controller 210 may be located on the BHA. Required DC 209 may be communicated directly to the drilling process 213. The required TF orientation 208 and required DC 209 may be downlinked to the tool face controller 210 and drilling process 213, respectively, if generated on surface or implemented directly into the tool face controller 210 and drilling process 213 if generated downhole. The required TF orientation 208 and the required DC 209 may also be communicated to the model parameter estimator 222.

At stage C, tool face controller 210 may implement the steering inputs to carry out the drilling process 213. The drilling process 213 may generate drilling process feedback 214 (i.e., drilling operation parameters measurements and attitude measurements) to assist in the next cycle of steering inputs generation.

At stage D, the required DC 209 may be implemented into the BHA to carry out the drilling process.

The follow section describes Linear parameter-varying (LPV) systems and the development of the LPV controller 204 that may be formulated as Linear Matrix Inequalities (LMIs) to maintain the borehole curvature within a user-specified desired range (i.e., setpoints 201).

The notation used in this specification is as follows. $\mathbb{R}$ shows the set of real numbers, $\mathbb{R}_+$ is the set of non-negative real numbers, and $\mathbb{R}^n$ and $\mathbb{R}^{k\times m}$ are used to denote the set of real vectors of dimension n and the set of real k×m matrices, respectively. $\mathbb{S}^n$ and $\mathbb{S}^n_{++}$ represent the set of real symmetric and real symmetric positive definite n×n matrices, respectively. M>0 and M≥0 (M<0 and M≤0) denote the positive (negative) definiteness and semi definiteness of the matrix M. The inverse and transpose of a real matrix M are shown by $M^T$ and $M^{-1}$, respectively. In a symmetric matrix, the asterisk * in the (i, j) element denotes the transpose of the (j, i) element. He[M] is Hermitian operator defined as $He[M] \triangleq M+M^T$.

Linear parameter-varying (LPV) systems may be linear dynamical systems whose dynamic characteristics depend on a time-varying measurable scheduling parameter vector. In this context of the LPV systems framework, the scheduling parameter vector may capture the dynamics of non-linear or time-varying systems in a systematic fashion. Traditional gain-scheduling controllers may be designed by interpolation of separately designed controllers for the system's operation points. Such design methods may suffer from implementation difficulties and lack of closed-loop stability and performance guarantees. In order to tackle these challenges, the LPV gain-scheduling control approach may be introduced to provide a direct, efficient, simple-to-implement, and systematic design process to meet closed-loop stability and performance of nonlinear and time-varying systems.

Here, a robust dynamic output-feedback LPV gain-scheduled controller may be designed for the automated curvature cruise problem (direction drilling advisory systems) in the context of induced $\mathcal{L}_2$-norm performance specifications. To this end, a generic LPV open-loop system with the following state-space realization (Equation 5) may be considered:

$$\begin{aligned}
\dot{x}(t)&=A(\rho(t))x(t)+B_1(\rho(t))w(t)+B_2(\rho(t))u(t),\\
z(t)&=C_1(\rho(t))x(t)+D_{11}(\rho(t))w(t)+D_{12}(\rho(t))u(t),\\
y(t)&=C_2(\rho(t))x(t)+D_{21}(\rho(t))w(t),\\
x(0)&=x_0
\end{aligned} \tag{5}$$

where $x(t)\in\mathbb{R}^n$ is the system state vector, $u(t)\in\mathbb{R}^{n_u}$ is the control input vector, $w(t)\in\mathbb{R}^{n_w}$ denotes the vector of exogenous disturbances with finite energy in the space $\mathcal{L}_2[0,\infty]$, $y(t)\in\mathbb{R}^{n_y}$ is the vector of measured output, $z(t)\in\mathbb{R}^{n_z}$ stands for the vector of controlled outputs, $x_0\in\mathbb{R}^n$ is the initial system condition. The state space matrices $A(\bullet)$, $B_1(\bullet)$, $B_2(\bullet)$, $C_1(\bullet)$, $C_2(\bullet)$, $D_{11}(\bullet)$, $D_{12}(\bullet)$, and $D_{21}(\bullet)$ may have rational dependence on the time-varying scheduling parameter vector, $\rho(\bullet)\in\mathcal{F}_p^v$ which may also be measurable in real-time. $\mathcal{F}_p^v$ is the set of allowable parameter trajectories (Equation 6) and may be defined as:

$$\mathcal{F}_p^v \triangleq \{\rho(t)\in\mathcal{C}(\mathbb{R}_+,\mathbb{R}^{n_s}):\rho(t)\in\mathcal{P},\ |\rho_i(t)|\le v_p,\ i=1,2,\ldots n_s\} \tag{6}$$

wherein $n_s$ is the number of parameters and $\mathcal{P}$ is a compact subset of $\mathbb{R}^s$, i.e., the parameter trajectories and parameter variation rates may be assumed bounded as defined.

The output-feedback LPV gain-scheduled control design procedure may consist of finding a full-order dynamic LPV controller in the form of Equation 7:

$$\begin{aligned}
\dot{x}_K(t)&=A_K(\rho(t))x_K(t)+B_K(\rho(t))y(t),\\
z(t)&=C_K(\rho(t))x_K(t)+D_K(\rho(t))y(t)
\end{aligned} \tag{7}$$

where $x_K(t)\in\mathbb{R}^n$ is the controller state vector. By substituting the controller (Equation 7) in the open-loop system (Equation 5), and assuming $x_{cl}^T(t)=[x^T(t)\ x_K^T(t)]$, the interconnected closed-loop system ($T_{zw}$) may be obtained as follows with Equation 8:

$$\begin{aligned}
\dot{x}_{cl}(t) &= A_{cl}(\rho(t))x_{cl}(t)+B_{cl}(\rho(t))\,w(t),\\
z(t) &= C_{cl}(\rho(t))x_{cl}(t)+D_{cl}(\rho(t))w(t),\\
A_{cl} &= \begin{bmatrix} A+B_2D_KC_2 & B_2C_K\\ B_KC_2 & A_K\end{bmatrix},\\
B_{cl} &= \begin{bmatrix} B_1+B_2D_KD_{21}\\ B_KD_{21}\end{bmatrix},\\
C_{cl} &= [C_1+D_{12}D_KC_2\quad D_{12}C_K]\\
D_{cl} &= D_{11}+D_{12}D_KD_{21}
\end{aligned} \tag{8}$$

where the dependence on the scheduling parameter has been dropped for brevity. The final designed controller should be able to meet objectives for the closed-loop system including input-output stability (asymptotic stability) of the closed-loop system (Equation 8) in the presence of parameter variations, uncertainty, and disturbances and minimization of the worst-case amplification of the controlled output (desired output) z to a disturbance signal w, (induced $\mathcal{L}_2$-norm of disturbance/output operator, $T_{zw}$) given by Equation 9:

$$\min\|T_{zw}\|_{i,2}=\min\sup_{\rho(t)\in\mathcal{F}_p^v}\ \sup_{\|w\|\neq 0,\ w\in\mathcal{L}_2}\frac{\|z\|_2}{\|w\|_2} \tag{9}$$

However, instead of solving for the optimal objective (Equation 9), the upper bound suboptimal problem may be solved as Equation 10:

$$\|z\|_2\le\gamma\|w\|_2 \tag{10}$$

where $\gamma$ is a positive scalar.

Accordingly, an extended form of the Bounded Real Lemma and a quadratic parameter dependent Lyapunov functions of the form $V(x_{cl}(t),\rho(t))=x_{cl}(t)\,P(\rho(t))\,x_{cl}(t)$ may be utilized to obtain less conservative results that may be valid for arbitrary bounded parameter variation rates. To this end, considering the closed-loop system (Equation 8), the following result may provide sufficient conditions for the synthesis of an output-feedback LPV controller, which may be formulated as convex optimization problems with LMI constraints. The designed LPV gain-scheduled controller may guarantee closed-loop asymptotic parameter-dependent quadratic (PDQ) stability and a specified performance level as defined in Equation 9.

A first theorem for a non-robust control design is now described. Considering the given open-loop LPV system (Equation 5), there may exist a gain-scheduled dynamic full-order output-feedback controller of the form of Equation 3 that may guarantee the closed-loop asymptotic stability and may satisfy the induced $\mathcal{L}_2$-norm performance condition $\|z\|_2\le\gamma\|w\|_2$, if there exist continuously differentiable parameter-dependent symmetric matrices $X,Y\in\mathbb{R}^s\to\mathbb{S}^n$, parameter-dependent matrices $\hat{A}\in\mathbb{R}^s\to\mathbb{R}^{n\times n}$, $\hat{B}\in\mathbb{R}^s\to\mathbb{R}^{n\times n_y}$, $\hat{C}\in\mathbb{R}^s\to\mathbb{R}^{n_u\times n}$, $\hat{D}\in\mathbb{R}^s\to\mathbb{R}^{n_u\times n_y}$ and a positive scalar $\gamma$ such that the following LMI conditions hold for all $\rho(t)\in\mathcal{F}_p^v$ (Equation 11 and Equation 12).

$$\begin{bmatrix}
\dot{X}+XA+\hat{B}C_2+(*) & * & * & *\\
\hat{A}^T+A+B_2\hat{D}C_2 & -\dot{Y}+AY+B_2\hat{C}+(*) & * & *\\
(XB_1+\hat{B}D_{21})^T & (B_1+B_2\hat{D}D_{21})^T & -\gamma I & *\\
C_1+D_{12}\hat{D}C_2 & C_1Y+D_{12}\hat{C} & D_{11}+D_{12}\hat{D}D_{21} & -\gamma I
\end{bmatrix}<0 \tag{11}$$

$$\begin{bmatrix} X & I\\ I & Y\end{bmatrix}\succ 0 \tag{12}$$

Subsequently, the LPV control design result of the first theorem may be expanded to guarantee robustness against modeling mismatch and parameter uncertainties. To this end, the plant matrices A and $B_2$ in Equation 5 may be considered to be uncertain system matrices, that is, $A_\Delta(\rho(t))=A(\rho(t))+\Delta A(\rho(t))$, $B_{2,\Delta}(\Delta(t))=B_2(\rho(t))+\Delta B_2(\rho(t))$ may be bounded matrices that may contain parametric uncertainties. The norm-bounded uncertainties may be assumed to satisfy the following relation (Equation 12):

$$\Delta A(t)=H\Delta(t)E_1,\ \Delta B_2(t)=H\Delta(t)E_2 \tag{13}$$

where $H \in \mathbb{R}^{n\times i}$, $E_1 \in \mathbb{R}^{j\times n}$, $E_2 \in \mathbb{R}^{j\times n_u}$ are known constant matrices and $\Delta(t) \in \mathbb{R}^{i\times j}$ is an unknown time-varying uncertainty matrix function satisfying the inequality (Equation 14):

$$\Delta^T(t)\Delta(t) \le I \tag{14}$$

Utilizing $A_\Delta(\rho(t))$ and $B_{2,\Delta}(\rho(t))$ for A and $B_2$ in LMI (7), the following result may present a condition for ensuring closed-loop robust stability and performance in the presence of norm-bounded uncertainties via an LPV control design of the form of Equation 7.

A second theorem for a robust control design is now described. There may exist a full-order robust output-feedback LPV controller (Equation 7) over the sets $\mathcal{F}_p^v$ with all admissible uncertainties $\Delta A(t)$ and $\Delta B_2(t)$ of the form (9) and all $\Delta(t)$ satisfying Equation 14, that may guarantee the closed-loop asymptotic stability and satisfies the induced $\mathcal{L}_2$-norm performance condition $\|z\|_2 \le \gamma\|w\|_2$, if there exist continuously differentiable parameter-dependent symmetric matrices $X, Y \in \mathbb{R}^s \to \mathbb{S}^n$, parameter-dependent matrices $\hat{A} \in \mathbb{R}^s \to \mathbb{R}^{n\times n}$, $\hat{B} \in \mathbb{R}^s \to \mathbb{R}^{n\times n_y}$, $\hat{C} \in \mathbb{R}^s \to \mathbb{R}^{n_u\times n}$, $\hat{D} \in \mathbb{R}^s \to \mathbb{R}^{n_u\times n_y}$ and a positive scalar $\gamma$ such that the following LMI condition (Equation 15) may hold for all $\rho(t) \in \mathcal{F}_p^v$.

$$\begin{bmatrix} \dot{X} + XA + \hat{B}C_2 + (*) & * & * & * & * & * & * & * \\ \hat{A}^T + A + B_2\hat{D}C_2 & -\dot{Y} + AY + B_2\hat{C} + (*) & * & * & * & * & * & * \\ (XB_1 + \hat{B}D_{21})^T & (B_1 + B_2\hat{D}D_{21})^T & -\gamma I & * & * & * & * & * \\ C_1 + D_{12}\hat{D}C_2 & C_1Y + D_{12}\hat{C} & D_{11} + D_{12}\hat{D}D_{21} & -\gamma I & * & * & * & * \\ H^TX & H^T & 0 & 0 & -\epsilon I & * & * & * \\ \epsilon E_1 & \epsilon E_1 Y & 0 & 0 & 0 & -\epsilon I & * & * \\ 0 & H^T & 0 & 0 & 0 & 0 & -\epsilon I & * \\ \epsilon E_2\hat{D}C_2 & \epsilon E_2\hat{C} & \epsilon E_2\hat{D}D_{21} & 0 & 0 & 0 & 0 & -\epsilon I \end{bmatrix} \tag{15}$$

A proof is now described. By substituting the matrices with additive norm-bounded uncertainties in the $\mathcal{L}_2$-gain performance LMI condition (Equation 11) of the first theorem, i.e., $A_\Delta(\rho(t))$ for A and $B_{2,\Delta}(\rho(t))$ for $B_2$ in Equation 11, the new LMI condition may be written as follows (Equation 16):

$$\text{Equation 11} + He\left(\begin{bmatrix} XH \\ H \\ 0 \\ 0 \end{bmatrix}\Delta(t)\,[E_1 \;\; E_1Y \;\; 0 \;\; 0]\right) + He\left(\begin{bmatrix} 0 \\ H \\ 0 \\ 0 \end{bmatrix}\Delta(t)\,[E_2\hat{D}C_2 \;\; E_2\hat{C} \;\; E_2\hat{D}D_{21} \;\; 0]\right) < 0 \tag{16}$$

Consider the following inequality (Equation 17)

$$\Theta\Delta(t)\Phi + \Phi^T\Delta^T(t)\Theta^T \le \epsilon^{-1}\Theta\Theta^T + \epsilon\Phi^T\Phi \tag{17}$$

which may hold for all scalars $\epsilon > 0$ and matrices $\Theta$ and $\Phi$ of appropriate dimensions. For the case in Equation 16, $\Theta = [\Theta_1 \; \Theta_2]$ and $\Phi = [\Phi_1 \; \Phi_2]$ where:

$$\Theta_1 = \begin{bmatrix} XH \\ H \\ 0 \\ 0 \end{bmatrix}, \Phi_1 = [E_1 \;\; E_1Y \;\; 0 \;\; 0], \quad \Theta_2 = \begin{bmatrix} 0 \\ H \\ 0 \\ 0 \end{bmatrix}, \Phi_2 = [E_2\hat{D}C_2 \;\; E_2\hat{C} \;\; E_2\hat{D}D_{21} \;\; 0] \tag{18}$$

Subsequently, by utilizing the inequality (Equation 17) and the Schur complement, the final LMI condition (Equation 15) may be obtained, and the proof may be complete.

It is noted that the results of the second theorem may extend prior results in robust LPV control design to the case of guaranteed robust performance to norm-bounded uncertainty in the plant matrices. Once the parameter-dependent LMI decision matrices (either from non-robust condition of the first theorem (Equation 11), or from robust condition of the second theorem (Equation 15), X, Y, $\hat{A}$, $\hat{B}$, $\hat{C}$, and $\hat{D}$ satisfying the LMI conditions Equation 11 or Equation 15 may be obtained, the output-feedback LPV controller matrices may be readily computed following the steps below.

First, determine M and N from the factorization problem (Equation 19)

$$I - XY = NM^T \tag{19}$$

where the obtained M and N matrices may be square and invertible in the case of a full-order controller.

Second, compute the controller matrices in the following order (Equation 20):

$$\begin{aligned} D_K &= \hat{D}, \\ C_K &= (\hat{C} - D_K C_2 Y)M^{-T}, \\ B_K &= N^{-1}(\hat{B} - XB_2D_K), \\ A_K &= -N^{-1}(XAY + XB_2D_KC_2Y + NB_KC_2Y + XB_2C_KM^T - \hat{A})M^{-T} \end{aligned} \tag{20}$$

Finally, the robust LPV control design process may involve the solution of the LMI Equation 11 or Equation 15 for the matrix parameters X, Y, $\hat{A}$, $\hat{B}$, $\hat{C}$, and $\hat{D}$ and subsequently the calculation of the LPV controller matrices from Equation 20.

The first and second theorem may result in an infinite-dimensional convex optimization problem with an infinite number of LMIs and decision variables since the scheduling parameter vector may belong to a continuous real vector space, $\rho(t) \in \mathcal{F}_p^v$. To address this obstacle, the gridding method of the parameter space may be utilized to convert the infinite-dimensional problem to a finite-dimensional convex optimization problem. In this regard, the matrix parameter functional dependence as $M(\rho(t)) = M_0 + \Sigma_{i=1}^{s}\rho_i(t)M_i$ may be selected, where $M(\rho(t))$ represents any of the parameter-dependent matrices appearing in the LMI conditions Equation 11 or Equation 15. Subsequently, by gridding the scheduling parameter space at appropriate intervals, a finite set of LMIs may be obtained to be solved for the unknown matrices and $\gamma$. The MATLAB toolbox YALMIP may be used to solve the introduced optimization problem. Additionally, it should be noted that due to the presence of derivatives of the parameter-dependent matrices in the LMI condition Equation 11, the parameter variation rate $\dot{\rho}$, may enter affinely in the LMIs, and it may be sufficient to check the LMI only at the vertices of the $\dot{\rho}$ parameter range.

The dynamic LPV control law (Equation 7) may be computed based on the procedures explained in previous section and may use the results of the first theorem (for non-robust control design) and the second theorem (for robust control design) and may use the controller state-space matrices from Equation 20. Such an output-feedback dynamic LPV controller may have a dynamic structure and may generate the steering input(s) based on the curvature error and attitude error inputs in real-time.

The control input (Equation 7) may be computed to account for current system state as represented by the current system state vector $x_s(t)$ which may include the state components/parameters curvature state, attitude state, and curvature error. Examples of steering inputs or steering recommendations include tool face orientation and the duty cycle (steering ratio). The steering inputs may be communicated to the BHA to carry out the drilling process.

Figure 3:
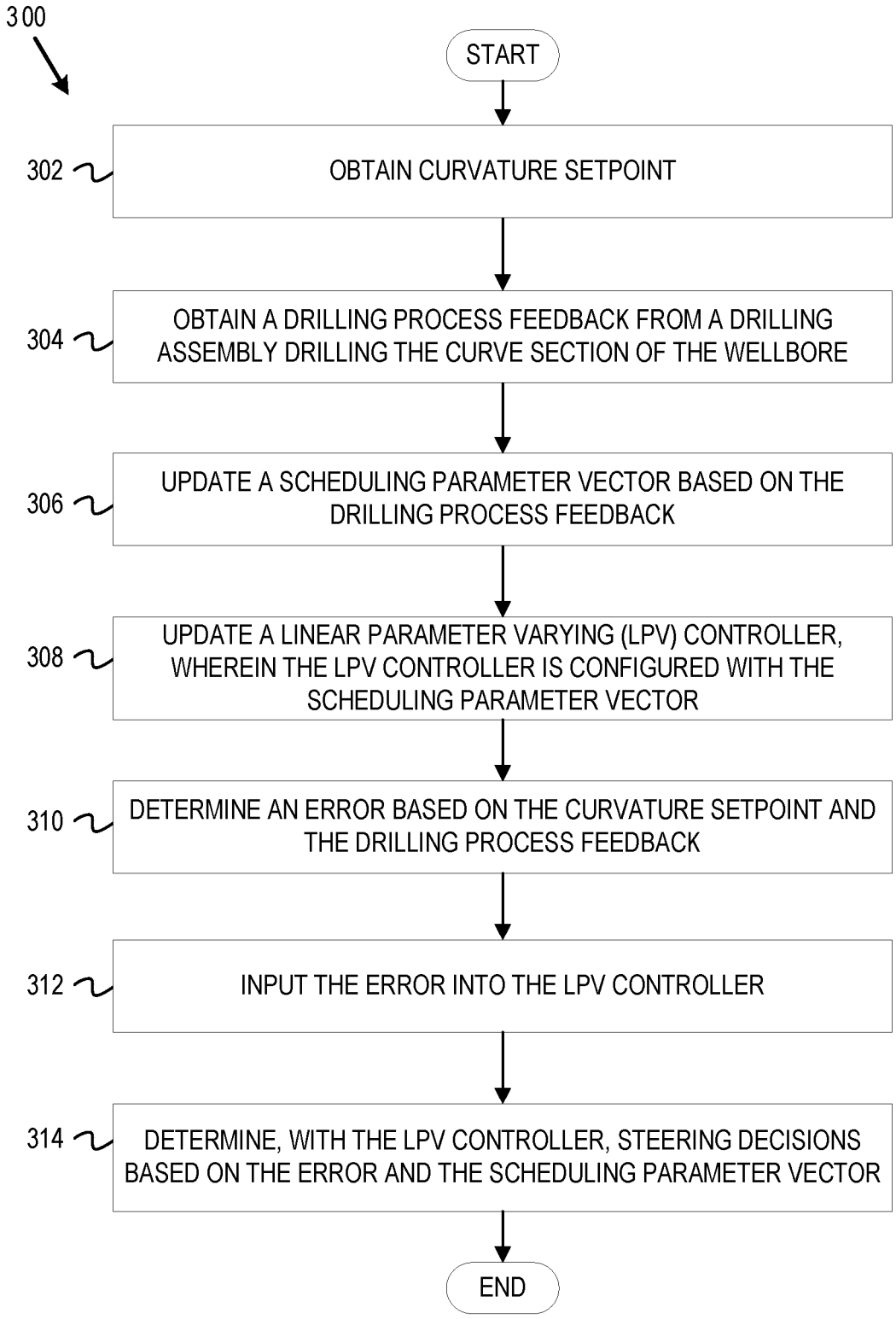
FIG. 3 depicts a flowchart of example operations to determine steering decisions, according to some embodiments.

FIG. 3 depicts a flowchart of example operations to determine steering decisions, according to some embodiments. Operations of flowchart 300 are described in reference to the computer 170 of FIG. 1. Operations of the flowchart 300 begin at block 302.

At block 302, a processor of the computer 170 may obtain a curvature setpoint.

At block 304, a processor of the computer 170 may obtain drilling process feedback from a drilling assembly drilling the curve section of the wellbore.

At block 306, a processor of the computer 170 may update a scheduling parameter vector based on the drilling process feedback.

At block 308, a processor of the computer 170 may update a linear parameter varying (LPV) controller, wherein the LPV controller may be configured with the scheduling parameter vector.

At block 310, a processor of the computer 170 may determine a first error based on the curvature setpoint and the drilling process feedback.

At block 312, a processor of the computer 170 may input the first error into the LPV controller.

At block 314, a processor of the computer 170 may determine steering decisions with the LPV controller based on the first error and the scheduling parameter vector.

Example Computer

FIG. 4 depicts an example computer, according to some embodiments. FIG. 4 depicts a computer 400 that includes a processor 401 (possibly including multiple processors, multiple cores, multiple nodes, and/or implementing multi-threading, etc.). The computer 400 includes a memory 407. The memory 407 may be system memory or any one or more of the above already described possible realizations of machine-readable media. The computer 400 also includes a bus 403 and a network interface 405.

The computer 400 also includes an LPV controller 411 and a controller 415. The LPV controller 411 and the controller 415 can perform one or more of the operations described herein. For example, the LPV controller 411 can determine the steering decisions. The controller 415 can perform various control operations to a drilling operation based on the steering decisions. For example, the controller 415 can implement the required tool face orientation into the drilling process.

Any one of the previously described functionalities may be partially (or entirely) implemented in hardware and/or on the processor 401. For example, the functionality may be implemented with an application specific integrated circuit, in logic implemented in the processor 401, in a co-processor on a peripheral device or card, etc. Further, realizations may include fewer or additional components not illustrated in FIG. 4 (e.g., video cards, audio cards, additional network interfaces, peripheral devices, etc.). The processor 401 and the network interface 405 are coupled to the bus 403. Although illustrated as being coupled to the bus 403, the memory 407 may be coupled to the processor 401.

While the aspects of the disclosure are described with reference to various implementations and exploitations, it will be understood that these aspects are illustrative and that the scope of the claims is not limited to them. In general, techniques for simulating drill bit abrasive wear and damage during the drilling of a wellbore as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment #1: A computer-implemented method for drilling a curve section of a wellbore in a subsurface formation comprising: obtaining a curvature setpoint: obtaining drilling process feedback from a drilling assembly drilling the curve section of the wellbore: updating a scheduling parameter vector based on the drilling process feedback: updating a controller, wherein the controller is configured with the scheduling parameter vector: determining an error based on the curvature setpoint and the drilling process feedback: inputting the error into the controller; and determining, via the controller, steering decisions based on the error and the scheduling parameter vector.

Embodiment #2: The method of Embodiment #1 further comprising: determining, with a model parameter estimator, model parameters based on the drilling process feedback: updating the scheduling parameter vector based on the modeling parameters.

Embodiment #3: The method of Embodiments #1 or 2 further comprising: determining steering inputs based on the steering decisions, wherein the steering inputs include tool face orientation and duty cycle: communicating the steering inputs to the drilling assembly: and performing a drilling operation with the drilling assembly.

Embodiment #4: The method of any one of Embodiments #1-3, wherein the steering decisions include walk rate effort and build rate effort.

Embodiment #5: The method of any one of Embodiments #1-4, wherein the controller is on surface or downhole.

Embodiment #6: The method of any one of Embodiments #1-5, wherein the drilling process feedback includes drilling operation parameters measurements and attitude measurements.

Embodiment #7: The method of any one of Embodiments #1-6, wherein the controller comprises a Linear Parameter Varying (LPV) controller.

Embodiment #8: A non-transitory computer-readable medium including computer-executable instructions comprising: instructions to obtain a curvature setpoint: instructions to obtain drilling process feedback from a drilling assembly drilling a curve section of a wellbore in a subsurface formation: instructions to update a scheduling parameter vector based on the drilling process feedback: instructions to update a controller, wherein the controller is configured with the scheduling parameter vector; instructions to determine an error based on the curvature setpoint and the drilling process feedback: instructions to input the error into the controller; and instructions to determine, with the controller, steering decisions based on the error and the scheduling parameter vector.

Embodiment #9: The non-transitory computer-readable medium of Embodiment #8 further comprising: instructions to determine, with a model parameter estimator, model parameters based on the drilling process feedback: instructions to update the scheduling parameter vector based on the modeling parameters.

Embodiment #10: The non-transitory computer-readable medium of Embodiments #8 or 9 further comprising: instructions to determine steering inputs based on the steering decisions, wherein the steering inputs include tool face orientation and duty cycle: instructions to communicate the steering inputs to the drilling assembly: and instructions to perform a drilling operation with the drilling assembly.

Embodiment #11: The non-transitory computer-readable medium of any one of Embodiments #8-10, wherein the steering decisions include walk rate effort and build rate effort.

Embodiment #12: The non-transitory computer-readable medium of any one of Embodiments #8-11, wherein the controller is on surface or downhole.

Embodiment #13: The non-transitory computer-readable medium of any one of Embodiments #8-12, wherein the drilling process feedback includes drilling operation parameters measurements and attitude measurements.

Embodiment #14: The non-transitory computer-readable medium of any one of Embodiments #8-13, wherein the controller comprises a Linear Parameter Varying (LPV) controller.

Embodiment #15: A system comprising: a processor: and a computer-readable medium having instructions stored thereon that are executable by the processor, the instructions including instructions to obtain a curvature setpoint: instructions to obtain drilling process feedback from a drilling assembly drilling a curve section of a wellbore in a subsurface formation; instructions to update a scheduling parameter vector based on the drilling process feedback; instructions to update a controller, wherein the controller is configured with the scheduling parameter vector; instructions to determine an error based on the curvature setpoint and the drilling process feedback; instructions to input the error into the controller; and instructions to determine, with the controller, steering decisions based on the error and the scheduling parameter vector.

Embodiment #16: The system of Embodiment #15 further comprising: instructions to determine, with a model parameter estimator, model parameters based on the drilling process feedback: instructions to update the scheduling parameter vector based on the modeling parameters.

Embodiment #17: The system of Embodiments #15 or 16 further comprising: instructions to determine steering inputs based on the steering decisions, wherein the steering inputs include tool face orientation and duty cycle: instructions to communicate the steering inputs to the drilling assembly; and instructions to perform a drilling operation with the drilling assembly.

Embodiment #18: The system of any one of Embodiments #15-17, wherein the steering decisions include walk rate effort and build rate effort.

Embodiment #19: The system of any one of Embodiments #15-18, wherein the controller is on surface or downhole.

Embodiments #20: The system of any one of Embodiments #15-19, wherein the controller comprises a Linear Parameter Varying (LPV) controller.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed:

1. A computer-implemented method for drilling a curve section of a wellbore in a subsurface formation comprising:
- obtaining a curvature setpoint;
- obtaining drilling process feedback from a drilling assembly drilling the curve section of the wellbore;
- updating a scheduling parameter vector based on the drilling process feedback;
- updating a controller, wherein the controller is configured with the scheduling parameter vector;
- determining an error based on the curvature setpoint and the drilling process feedback;
- inputting the error into the controller;
- determining, via the controller, steering decisions based on the error and the scheduling parameter vector; and
- performing a drilling operation using the determined steering decisions with the drilling assembly.

2. The method of claim 1 further comprising:
- determining, with a model parameter estimator, model parameters based on the drilling process feedback;
- updating the scheduling parameter vector based on the modeling parameters.

3. The method of claim 1 further comprising:
- determining steering inputs based on the steering decisions, wherein the steering inputs include tool face orientation and duty cycle;
- communicating the steering inputs to the drilling assembly; and
- performing the drilling operation with the drilling assembly.

4. The method of claim 1, wherein the steering decisions include walk rate effort and build rate effort.

5. The method of claim 1, wherein the controller is on surface or downhole.

6. The method of claim 1, wherein the drilling process feedback includes drilling operation parameters measurements and attitude measurements.

7. The method of claim 1, wherein the controller comprises a Linear Parameter Varying (LPV) controller.

8. A non-transitory computer-readable medium including computer-executable instructions comprising:
- instructions to obtain a curvature setpoint;
- instructions to obtain drilling process feedback from a drilling assembly drilling a curve section of a wellbore in a subsurface formation;
- instructions to update a scheduling parameter vector based on the drilling process feedback;

instructions to update a controller, wherein the controller is configured with the scheduling parameter vector;

instructions to determine an error based on the curvature setpoint and the drilling process feedback;

instructions to input the error into the controller;

instructions to determine, with the controller, steering decisions based on the error and the scheduling parameter vector; and instructions to perform a drilling operation using the determined steering decisions with the drilling assembly.

9. The non-transitory computer-readable medium of claim 8 further comprising:

instructions to determine, with a model parameter estimator, model parameters based on the drilling process feedback;

instructions to update the scheduling parameter vector based on the modeling parameters.

10. The non-transitory computer-readable medium of claim 8 further comprising:

instructions to determine steering inputs based on the steering decisions, wherein the steering inputs include tool face orientation and duty cycle;

instructions to communicate the steering inputs to the drilling assembly; and instructions to perform the drilling operation with the drilling assembly.

11. The non-transitory computer-readable medium of claim 8, wherein the steering decisions include walk rate effort and build rate effort.

12. The non-transitory computer-readable medium of claim 8, wherein the controller is on surface or downhole.

13. The non-transitory computer-readable medium of claim 8, wherein the drilling process feedback includes drilling operation parameters measurements and attitude measurements.

14. The non-transitory computer-readable medium of claim 8, wherein the controller comprises a Linear Parameter Varying (LPV) controller.

15. A system comprising:

a processor; and a computer-readable medium having instructions stored thereon that are executable by the processor, the instructions including instructions to obtain a curvature setpoint;

instructions to obtain drilling process feedback from a drilling assembly drilling a curve section of a wellbore in a subsurface formation;

instructions to update a scheduling parameter vector based on the drilling process feedback;

instructions to update a controller, wherein the controller is configured with the scheduling parameter vector;

instructions to determine an error based on the curvature setpoint and the drilling process feedback;

instructions to input the error into the controller;

instructions to determine, with the controller, steering decisions based on the error and the scheduling parameter vector; and instructions to perform a drilling operation using the determined steering decisions with the drilling assembly.

16. The system of claim 15 further comprising:

instructions to determine, with a model parameter estimator, model parameters based on the drilling process feedback;

instructions to update the scheduling parameter vector based on the modeling parameters.

17. The system of claim 15 further comprising:

instructions to determine steering inputs based on the steering decisions, wherein the steering inputs include tool face orientation and duty cycle;

instructions to communicate the steering inputs to the drilling assembly; and instructions to perform the drilling operation with the drilling assembly.

18. The system of claim 15, wherein the steering decisions include walk rate effort and build rate effort.

19. The system of claim 15, wherein the controller is on surface or downhole.

20. The system of claim 15, wherein the controller comprises a Linear Parameter Varying (LPV) controller.

* * * * *